US010418747B2

(12) United States Patent
Zhao

(10) Patent No.: US 10,418,747 B2
(45) Date of Patent: Sep. 17, 2019

(54) ELECTRICAL CONNECTOR HAVING AN IMPROVED O-RING

(71) Applicant: FOXCONN INTERCONNECT TECHNOLOGY LIMITED, Grand Cayman (KY)

(72) Inventor: Jun Zhao, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/984,431

(22) Filed: May 21, 2018

(65) Prior Publication Data

US 2018/0337489 A1 Nov. 22, 2018

(30) Foreign Application Priority Data

May 19, 2017 (CN) ..... 2017 1 0357302

(51) Int. Cl.

| | |
|---|---|
| ***H01R 13/52*** | (2006.01) |
| ***H01R 13/6581*** | (2011.01) |
| *H01R 13/504* | (2006.01) |
| *H01R 24/60* | (2011.01) |
| *H01R 107/00* | (2006.01) |
| *H01R 12/72* | (2011.01) |

(52) U.S. Cl.

CPC ..... *H01R 13/5219* (2013.01); *H01R 13/521* (2013.01); *H01R 13/5202* (2013.01); *H01R 13/6581* (2013.01); *H01R 12/725* (2013.01); *H01R 13/504* (2013.01); *H01R 24/60* (2013.01); *H01R 2107/00* (2013.01)

(58) Field of Classification Search

CPC ..... H01R 13/5202; H01R 13/5205; H01R 13/5219; H01R 13/5221; H01R 33/965

USPC ..... 439/271

See application file for complete search history.

(56) References Cited

U.S. PATENT DOCUMENTS

| | | | | |
|---|---|---|---|---|
| 3,999,095 | A * | 12/1976 | Pearce, Jr. | H01K 1/46 313/318.1 |
| 4,925,404 | A * | 5/1990 | Dutcher | H01R 9/032 439/607.01 |
| 6,176,744 | B1 * | 1/2001 | Zito | H01R 13/035 439/660 |
| 8,475,216 | B2 * | 7/2013 | Tung | H01R 13/506 439/607.4 |
| 9,112,299 | B2 * | 8/2015 | Lu | H01R 13/5227 |
| 9,997,865 | B2 * | 6/2018 | Yao | H01R 4/28 |

(Continued)

FOREIGN PATENT DOCUMENTS

| | | |
|---|---|---|
| CN | 107404032 | 11/2017 |
| TW | I578636 | 4/2017 |

*Primary Examiner* — Phuong K Dinh

(74) *Attorney, Agent, or Firm* — Wei Te Chung; Ming Chieh Chang

(57) ABSTRACT

An electrical connector includes an insulative housing, a number of conductive contacts affixed to the insulative housing, a shell enclosing the insulative housing, and an o-ring attached to a front end of the shell. The insulative housing includes a base portion and a tongue portion extending forwardly from the base portion. The shell includes a front surface, an outer surface, and an inner surface. There exists a mating room between the inner surface of the shell and the tongue portion. The o-ring includes an internal attached surface attached to the inner surface of the shell.

9 Claims, 10 Drawing Sheets

(56) References Cited

U.S. PATENT DOCUMENTS

| | | | | |
|---|---|---|---|---|
| 2016/0164218 | A1* | 6/2016 | Lee | H01R 13/5202<br>439/587 |
| 2016/0233594 | A1 | 8/2016 | Zhao et al. | |

* cited by examiner

ELECTRICAL CONNECTOR HAVING AN IMPROVED O-RING

BACKGROUND OF THE DISCLOSURE

1. Field of the Disclosure

The present disclosure relates to an electrical connector, and more particularly to an electrical connector for waterproof.

2. Description of Related Arts

U.S. Patent Application Publication No. 2016/0233594 discloses an electrical connector including an insulative housing, a plurality of terminals affixed to the insulative housing, a shielding shell enclosing the insulative housing, and an o-ring attached to a front end of the shielding shell. The o-ring could achieve waterproof between the shielding shell and the corresponding electrical device. However, the o-ring does not seal between the electrical connector and a mating electrical connector such moisture may still enter.

An improved electrical connector is desired.

SUMMARY OF THE DISCLOSURE

Accordingly, an object of the present disclosure is to provide an electrical connector for waterproof.

To achieve the above object, an electrical connector includes an insulative housing, a plurality of conductive contacts affixed to the insulative housing, a shell enclosing the insulative housing, and an o-ring attached to a front end of the shell. The insulative housing includes a base portion and a tongue portion extending forwardly from the base portion. The shell includes a front surface, an outer surface, and an inner surface. There exists a mating room between the inner surface of the shell and the tongue portion. The o-ring includes an internal attached surface attached to the inner surface of the shell. The o-ring not only could achieve waterproof between the electrical connector and the corresponding electrical device, but also could achieve waterproof between the electrical connector and a mating electrical connector.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
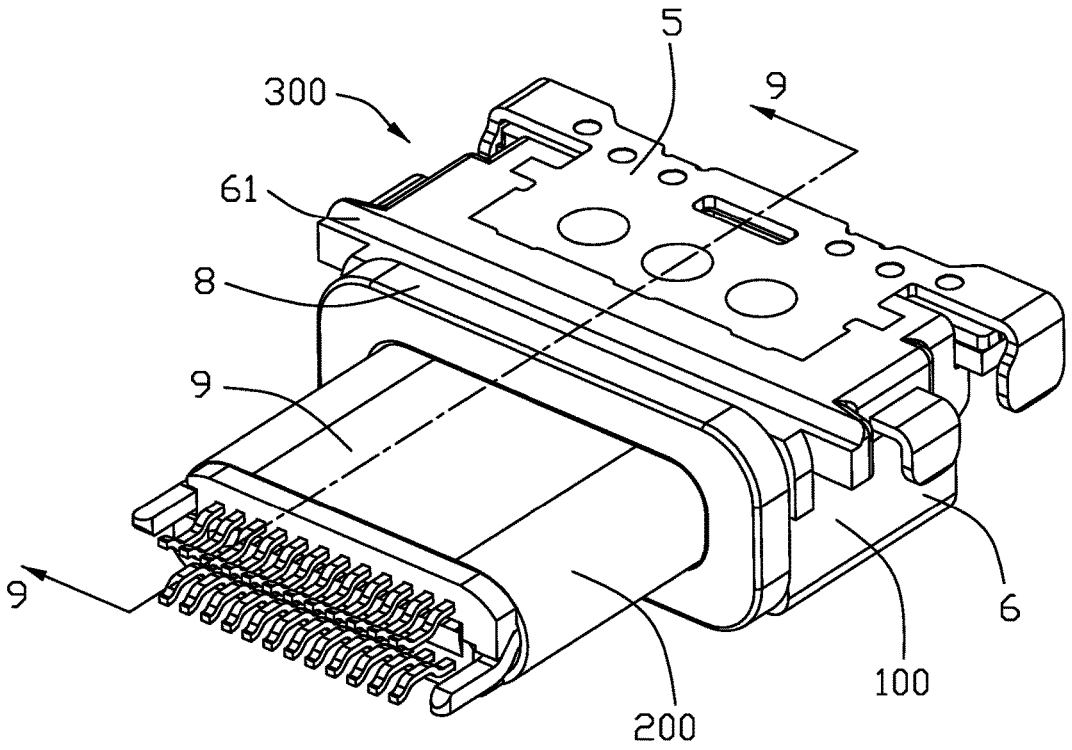
FIG. 1 is a perspective, assembled view of an electrical connector assembly when an electrical connector is mated with a corresponding electrical connector.
Figure 2:
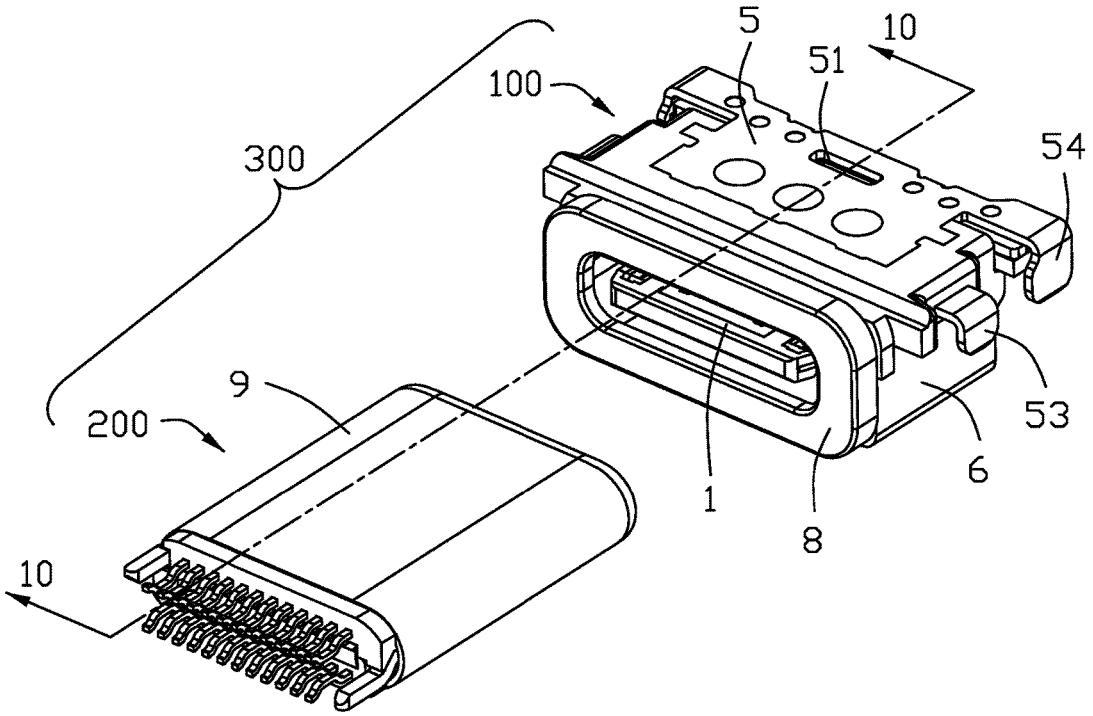
FIG. 2 is a perspective, assembled view of the electrical connector assembly when the electrical connector is not mated with the corresponding electrical connector.

Reference will now be made in detail to the embodiments of the present disclosure. An embodiment of an electrical connector assembly 300 is shown in FIGS. 1 to 10. The electrical connector assembly 300 includes an electrical receptacle connector 100 and a corresponding electrical plug connector 200. The plug-in direction of the electrical connector 100 is a front-to-rear direction.

Referring to FIGS. 1 to 8, the electrical connector 100 includes an insulative housing 1, a number of conductive contacts 2 affixed to the insulative housing 1, a shielding plate 3 affixed to the insulative housing 1, a shell (subassembly) enclosing the insulative housing 1 for forming a mating room 40, a sealer 7 sealing a rear end of the electrical connector 100, and an o-ring or compressible extension 8 attached to a front end region of the shell (subassembly).

Figure 7:
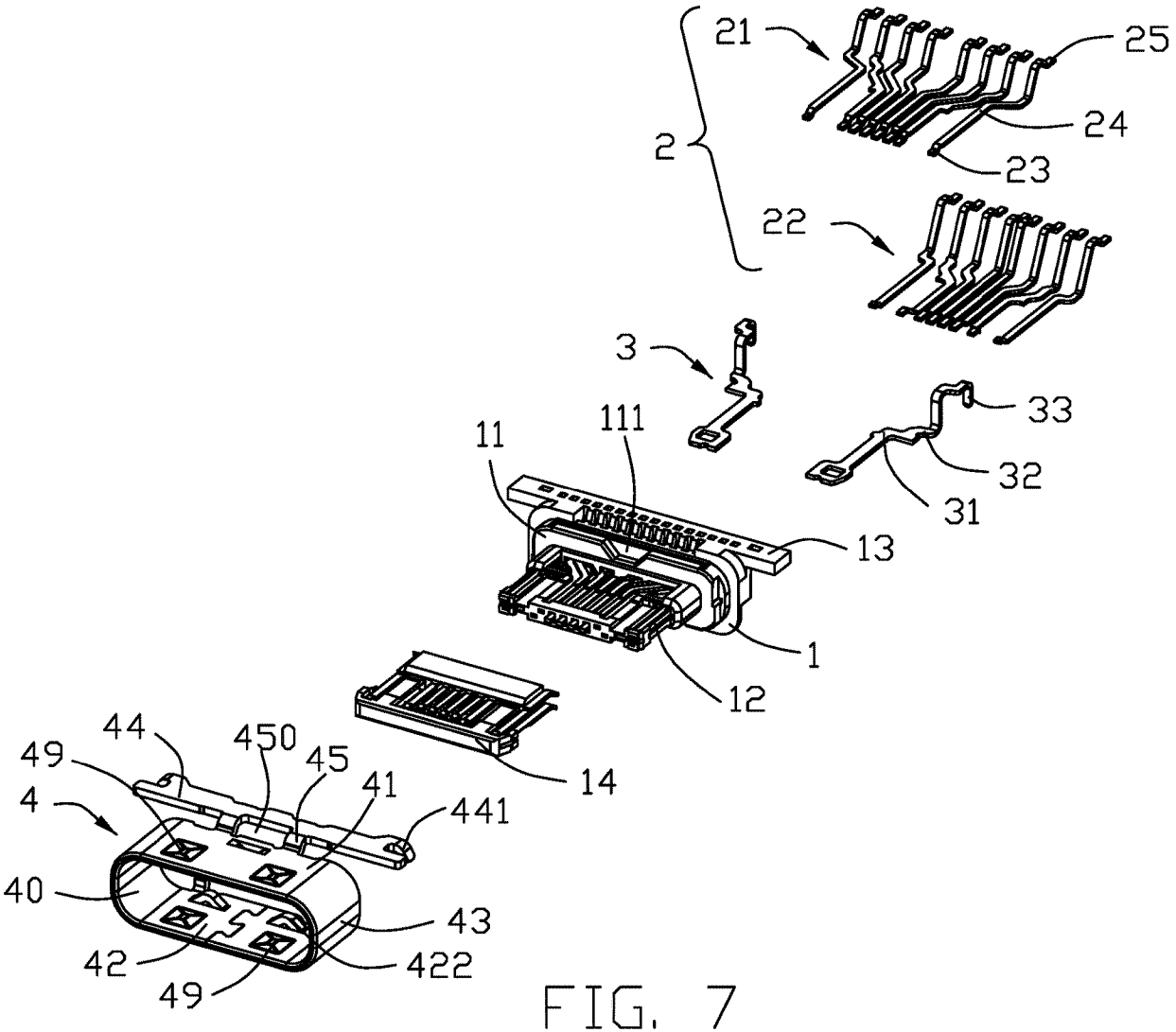
FIG. 7 is a partial exploded view of an insulative housing, a number of conductive contacts and a shielding shell.
Figure 8:
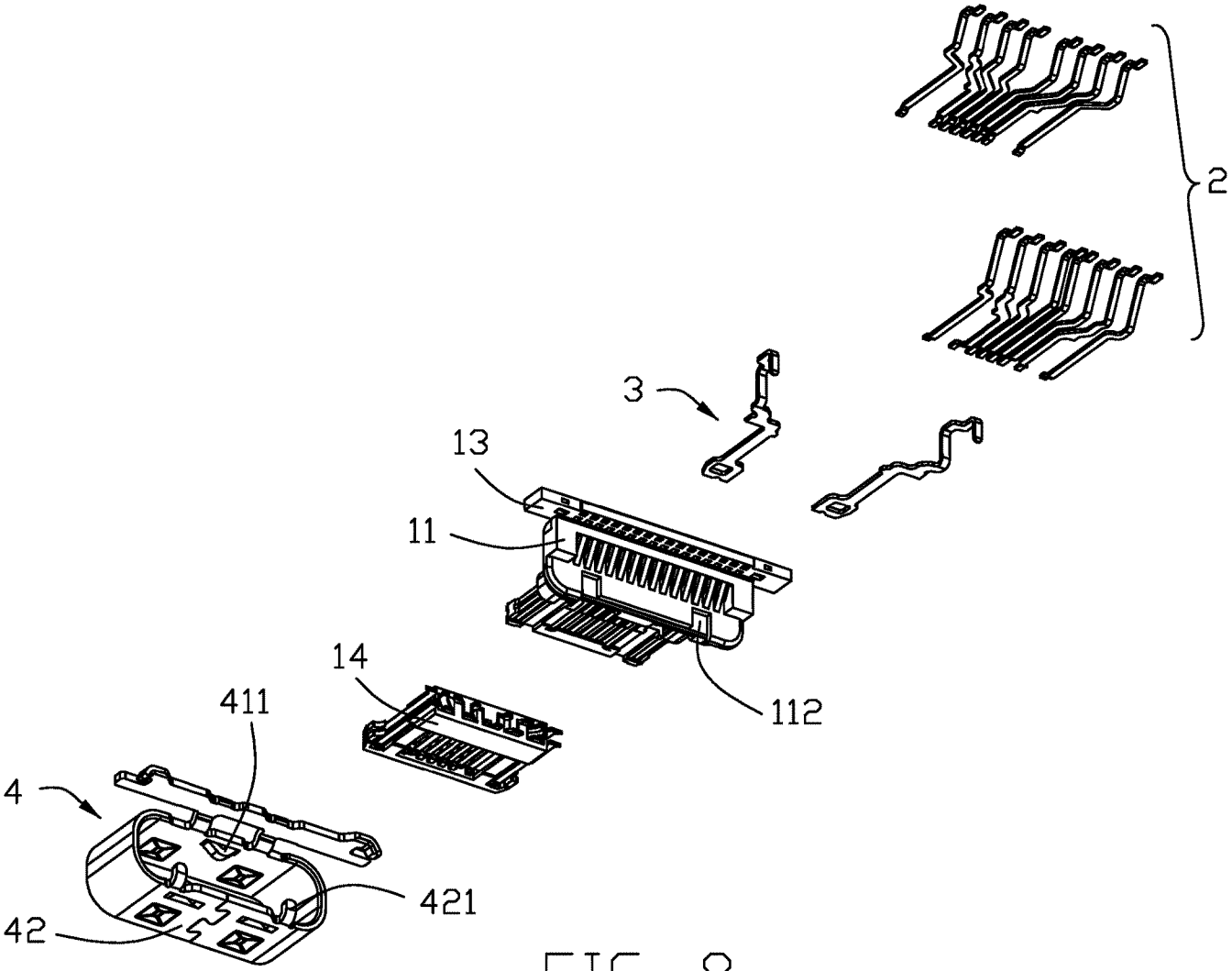
FIG. 8 is another partial view of the electrical connector taken from FIG. 7.

Referring to FIGS. 7 to 8, the insulative housing 1 includes a base portion 11 and a tongue portion 12 extending forwardly from the base portion 11 and forming the mating room 40 with the shell. The insulative housing 1 further includes a number of resisting grooves 111 located at a boundary between the base portion 11 and the tongue portion 12, a pair of buckling grooves 112 located at a rear surface of the base portion 11, a rear portion 13 located at a rear end of the base portion 11, and an insulator 14 located in front of the tongue portion 12.

Referring to FIGS. 7 to 8, the conductive contacts 2 include a number of first contacts 21 disposed in an upper row and a number of second contacts 22 disposed in a lower row. Each conductive contact 2 includes a contacting portion 23 exposed to the tongue portion 12, a fixed portion 24 affixed to the insulative housing 1, and a soldering portion 25 extending rearward from the rear portion 13.

Referring to FIGS. 7 to 8, the shielding plate 3 is affixed to the insulative housing 1 and sandwiched between the first contacts 21 and the second contacts 22. Each shielding plate 3 includes a main portion 31, an extending portion 32 extending rearward from the main portion 31, and a soldering pin 33 extending rearward from the extending portion 32. The soldering pins 33 of the shielding plate 3 are located laterally beside the soldering portions 25 of the conductive contacts 2.

The shell includes a cylindrical shielding shell 4 and an outer shell 6 using for waterproof. In other embodiments, the shell may be the shielding shell. The o-ring 8 is attached to the inner surface of the front end of the shielding shell.

Figure 5:
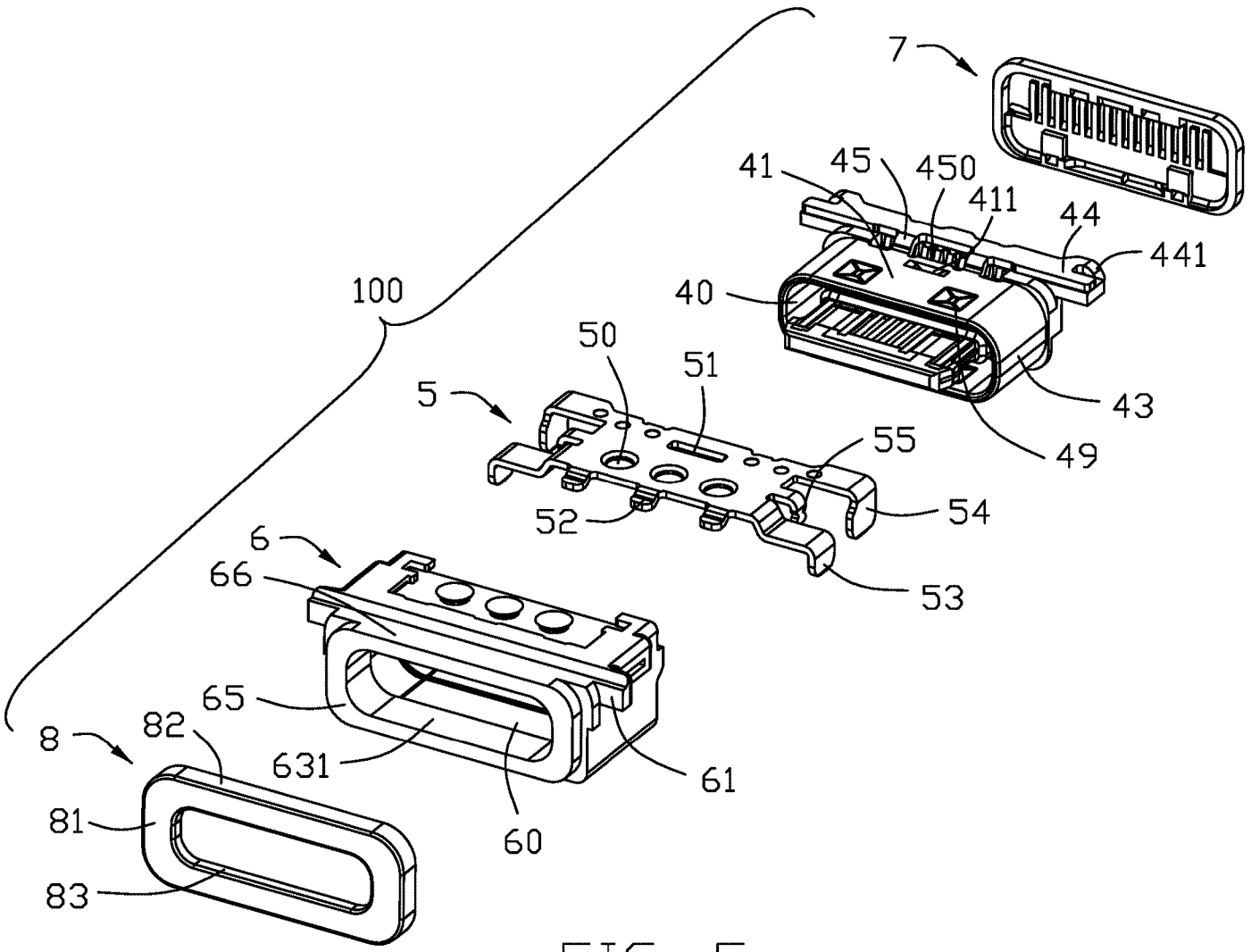
FIG. 5 is a further exploded view of the electrical connector.
Figure 6:
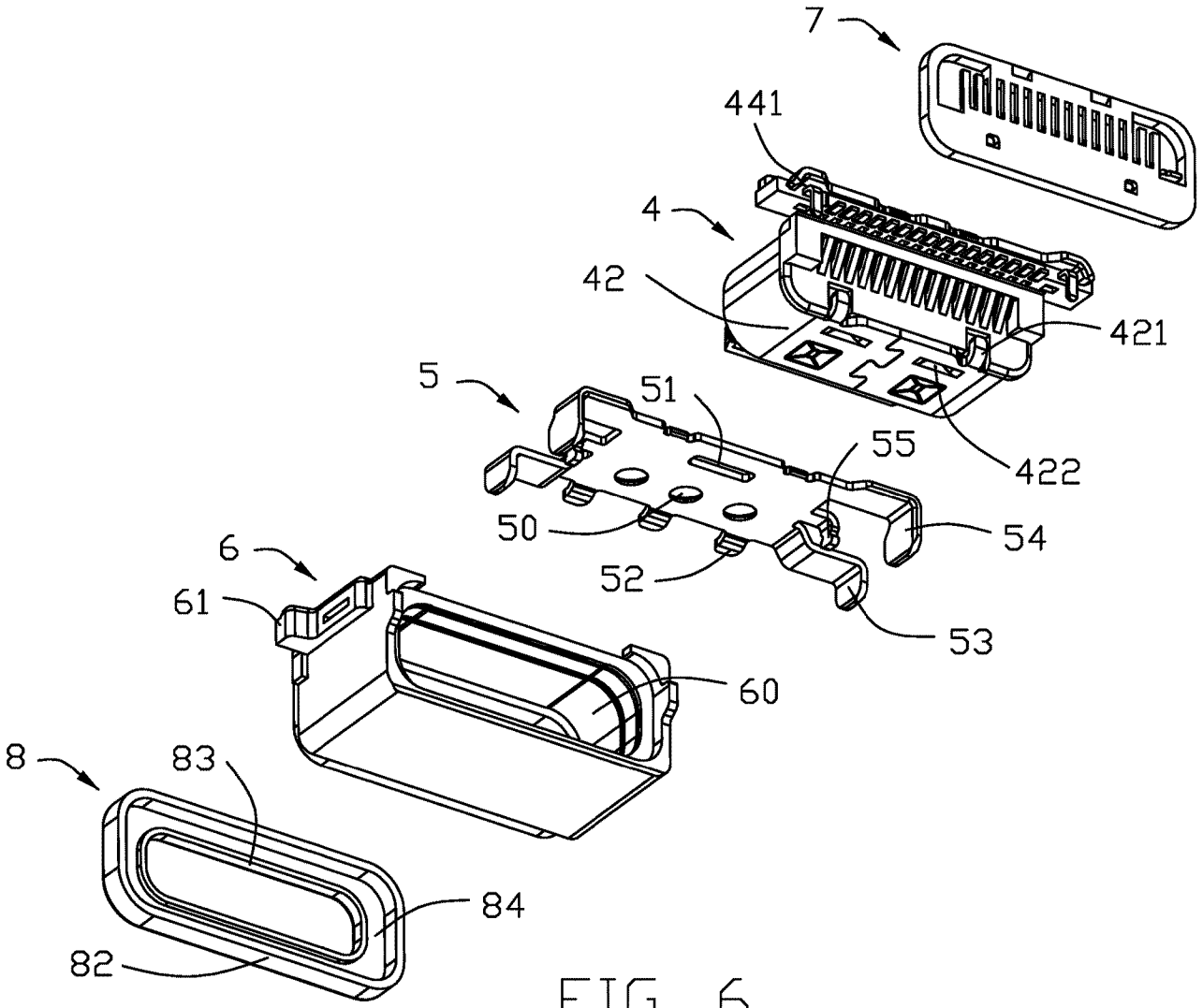
FIG. 6 is another further exploded view of the electrical connector taken from FIG. 5.

Referring to FIGS. 5 to 10, the shielding shell 4 includes a top wall 41, a bottom wall 42 opposite to the top wall 41, a pair of lateral walls 43 connecting the top wall 41 and the bottom wall 42, a tail 44 located at a rear end of the top wall 41 and higher than the top wall 41, and a pair of connecting arms 46 connecting the tail 44 and the top wall 41. The top wall 41 includes a number of first resisting tubers 411 resisting against the resisting grooves 111. The bottom wall 42 includes a pair of first buckling tubers 421 bending upwardly and resisting against the buckling grooves 112, and a pair of second resisting tubers 422 protruding into the mating room 40 and located in front of the buckling tubers 421. The second resisting tubers 422 resist against a front surface of the base portion 11. Referring to FIGS. 5 to 10, the first resisting tubers 411 and the second resisting tubers 422 are disposed at a three-point-structure preventing the electrical connector 100 from being damaged when the corresponding electrical connector 200 is excessively inserted. The tail 44 includes a pair of second buckling tubers 441 bending downwardly and revisiting against a rear surface of the rear portion 13. Referring to FIGS. 5 to 6, the tail 44 is attached to a top surface of the rear portion 13. There exists an opening 450 between the connecting arms in a transverse direction. The tongue portion 12 protrudes forwardly and outwardly from the front end of the shielding shell 4. The base portion 11 encloses a rear opening of the shielding shell 4 enhancing the sealing effect of the electrical connector 100.

Figure 3:
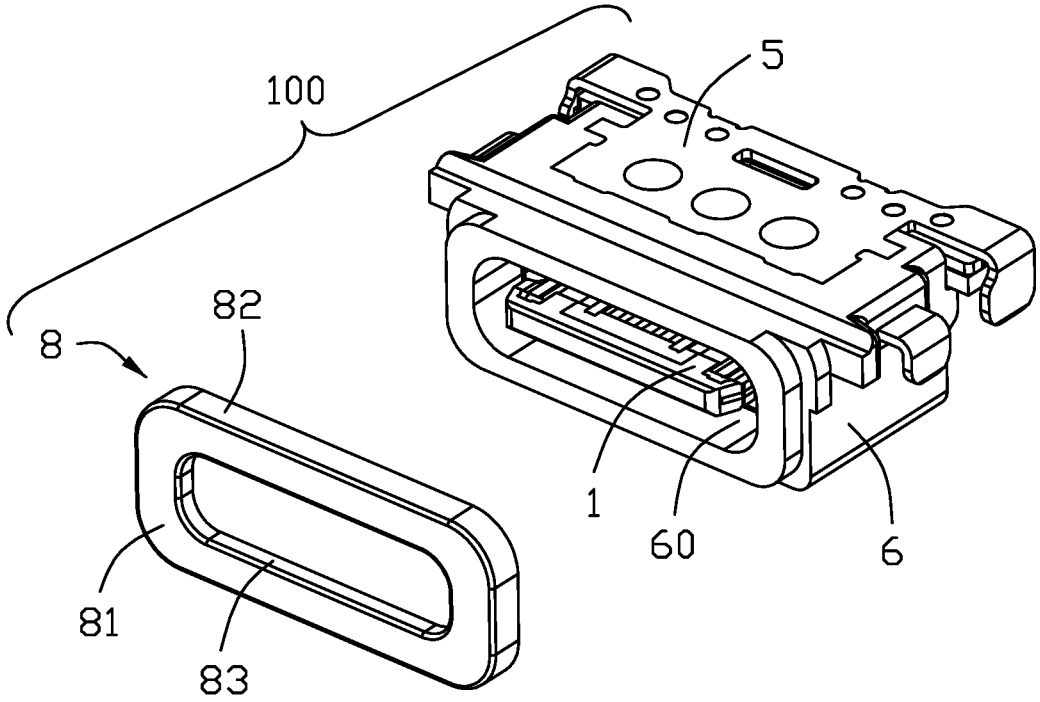
FIG. 3 is a partial exploded view of the electrical connector when an o-ring is not attached to the electrical connector.
Figure 4:
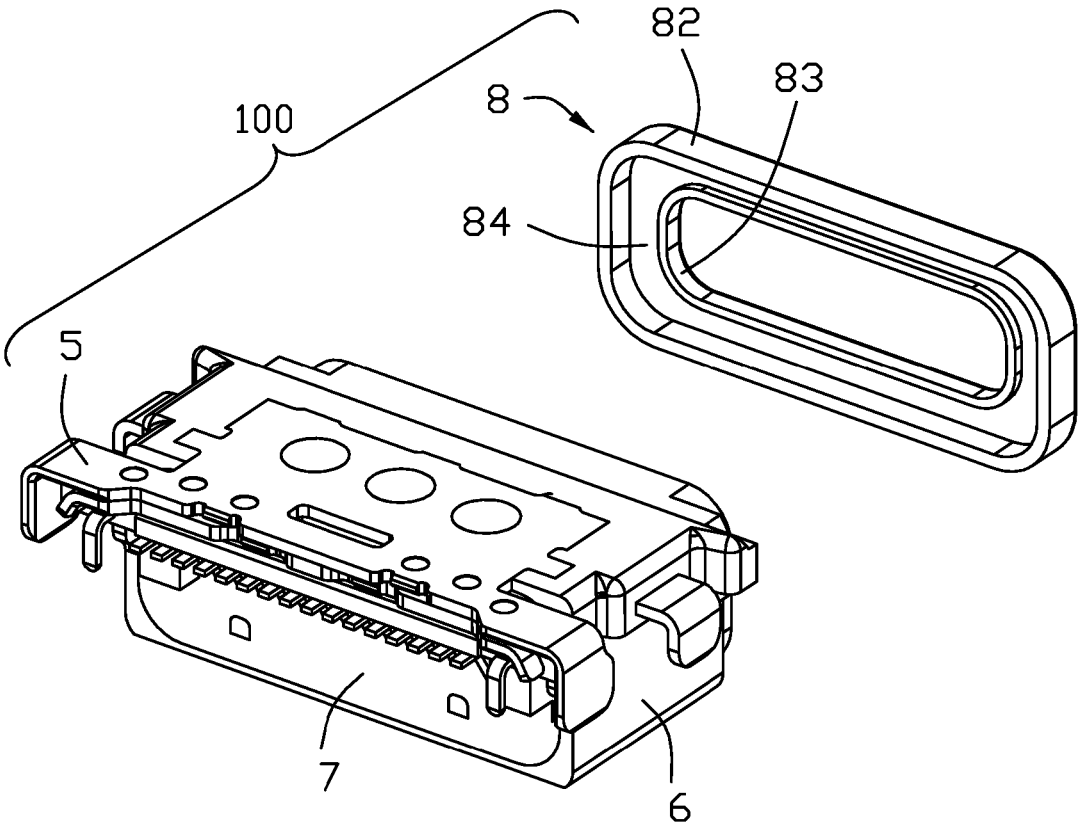
FIG. 4 is another partial exploded view of the electrical connector taken from FIG. 3.

Referring to FIGS. 1 to 6, a metal shell 5 is substantially covered in a flat plate shape on the shielding shell 4. Referring to FIGS. 5 and 6, the metal shell 5 includes a number of overfill holes 50 and a number of vents 51 located at a rear end of the overfill holes 50. The vents 51 communicate with the opening 450. The metal shell 5 includes a number of first bending portions 52 located at a front end thereof and resisting against a top surface of the top wall 41. The metal shell 5 includes a pair of first affixed portions 53 bending downwardly and located laterally, a pair of second affixed portions 54, and a pair of second bending portions 55 located between the first affixed portions 53 and the second affixed portions 54. Referring to FIGS. 3 to 5, the second bending portions 55 are latched laterally beside the base portion 11. The first affixed portions 53 are lower than the second affixed portions 54 in the vertical direction. Referring to FIG. 3, the metal shell 5 is welded to the tail 44 at the rear end. The second affixed portions 54 are suspended on the outside of the tail 44.

The outer shell 6 is integrated with the metal shell 5. The outer shell 6 includes a receiving room 60 receiving the shielding shell 4. The receiving room 60 receives the tongue portion 12 extending outwardly from the shielding shell 4. Referring to FIGS. 4 to 10, a rear surface of the outer shell 6 is located in front of the rear portion 13 and the tail 44. The outer shell 6 includes a number of protrusions 61 protruding laterally enhancing the strength of the electrical connector 100. The outer shell 6 fills the overfill holes 50 to enhance the strength between the outer shell 6 and the metal shell 5. The first affixed portions 53 of the metal shell 5 are partially enclosed by the outer shell 6 reducing the risk of dimensional instability of the first affixed portions 53 caused by the integrated molding of the outer shell 6 and the metal shell 5.

Figure 9:
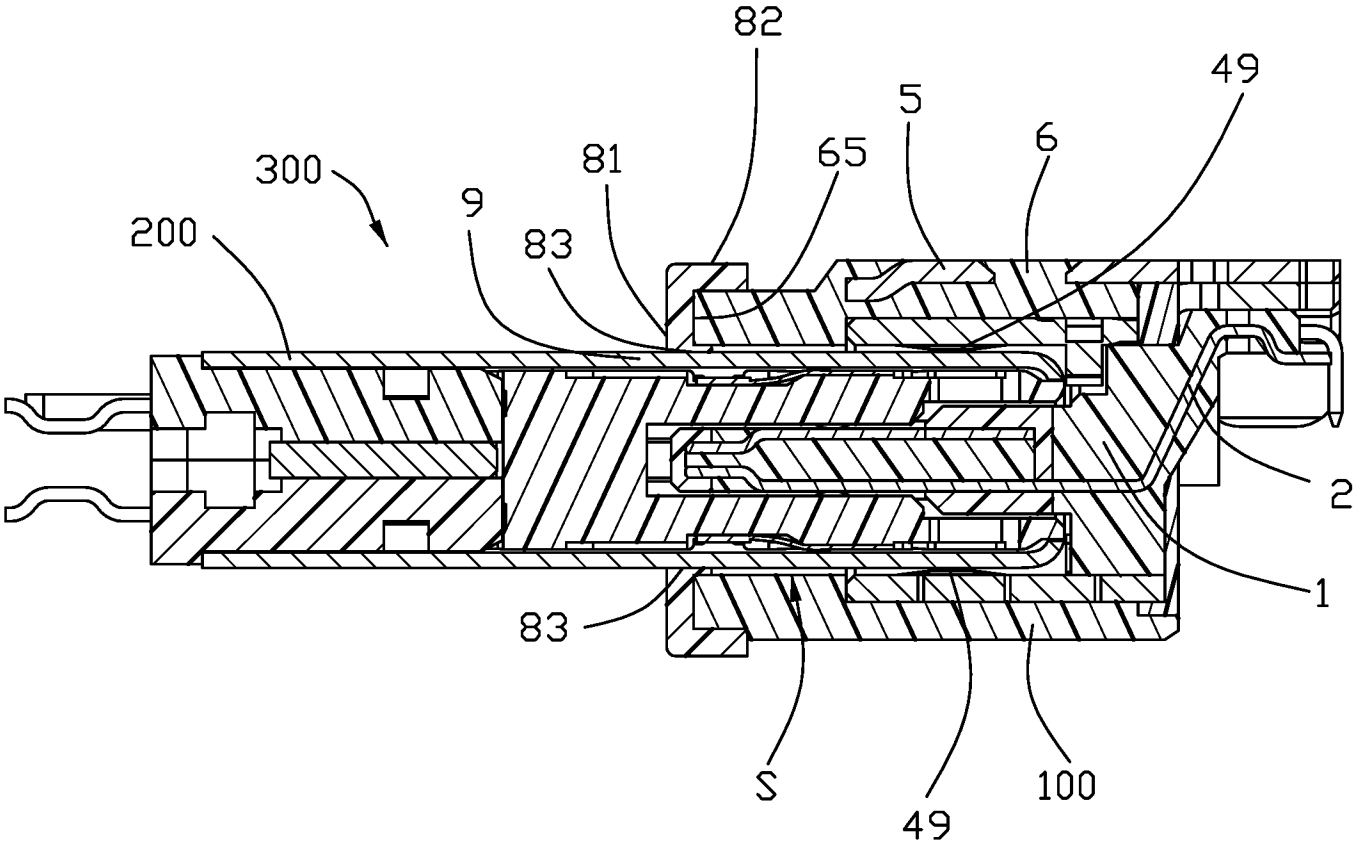
FIG. 9 is a cross-sectional view of the electrical connector taken along line 9-9 in FIG. 1.
Figure 10:
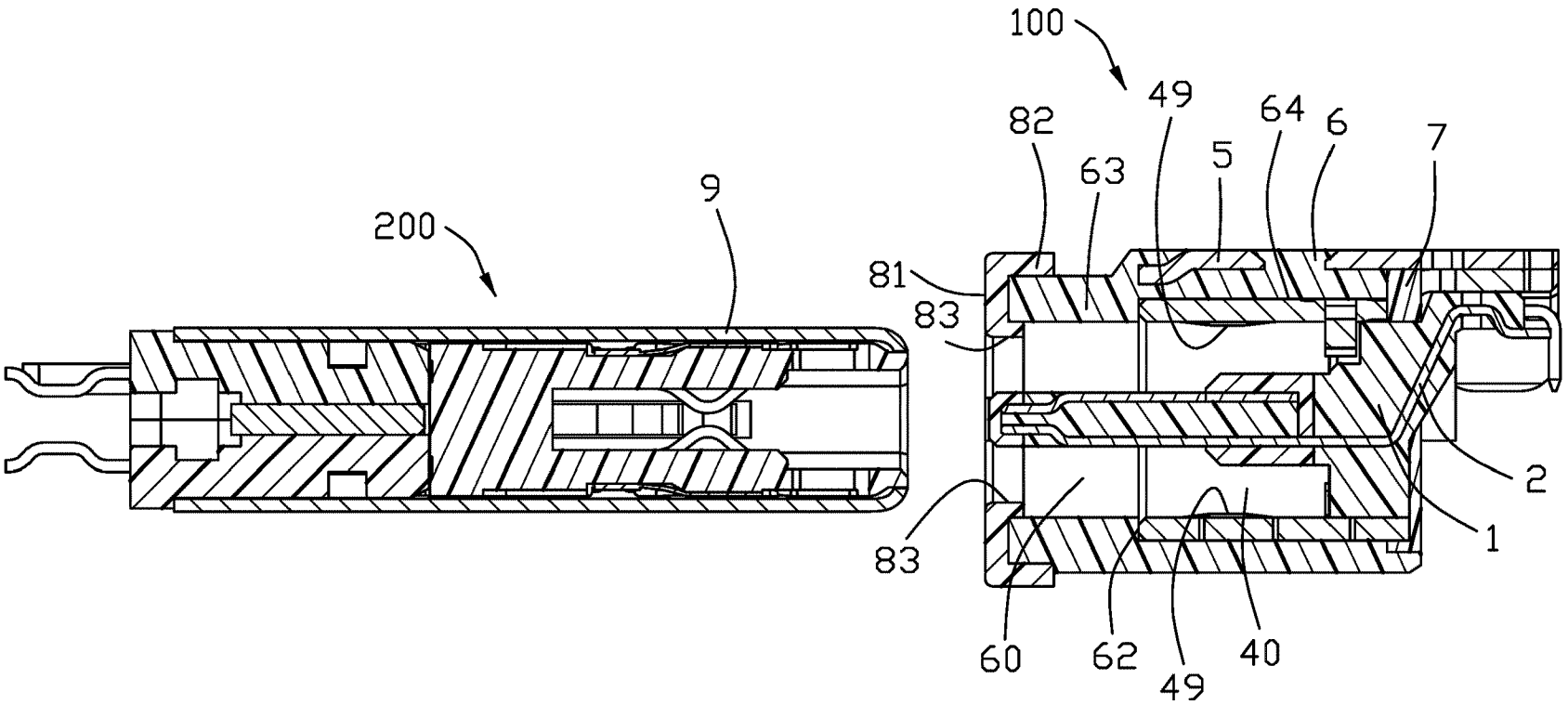
FIG. 10 is a cross-sectional view of the electrical connector taken along line 10-10 in FIG. 2.

Referring to FIGS. 9 to 10, the inner surface of the outer shell 6 includes a front inner wall 63, and a rear inner wall 64 recessed in the front inner wall 63 and having a stepped portion 62. The dimension of the pair of the front inner wall 63 is smaller than that of the pair of the rear inner wall 64. The front inner wall 63 includes an inner attached surface 631. The top wall 41 and the bottom wall 42 of the shielding shell 4 are attached to the rear inner wall 64 making the front end of the shielding shell 4 resist against the stepped portion 62 of the outer shell 6 and an upper edge and a lower inner edge of the shielding shell 4 flush with the front inner wall 63. The outer shell 6 includes a front surface 65 and an outer attached surface 66 located outside of the front inner wall 63 and opposite to the inner attached surface 631.

Referring to FIGS. 4-6 and 9-10, the o-ring 8 is liquid silicone molded on the front end of the outer shell 6 and attached to the inner attached surface 631 and outer attached surface 66. In other embodiments, the o-ring may be in a two-piece structure respectively attached to the inner attached surface 631 and outer attached surface 66. The o-ring 8 includes an annular receiving slot 84 communicating the rear end and not the front end and receiving the front end of the outer shell 6, a front attached surface 81 attached to the front surface 65, an external attached surface 82 attached to outer attached surface 66, and an internal attached surface 83 attached to the inner attached surface 631. The o-ring 8 enfolds the front end of the outer shell 6 completely.

Since in the present embodiment, the size of the outer shell 6 in the front-to-rear direction is larger than that of the shielding shell 4 and due to the existence of the stepped portion 62, the shielding shell 4 is accommodated in the outer shell 6. The o-ring 8 covers the inner attached surface 631 and the outer attached surface 66 of the outer shell 6, and the external attached surface 82 and the internal attached surface 83 are exposed to the air. In other embodiments, the size of the outer shell 6 in the front-to-rear direction is same as that of the shielding shell 4, the internal attached surface 83 is attached to the inner surface of the shielding shell 4 and the external attached surface 82 is attached to outer attached surface 66 or located between the shielding shell 4 and the outer shell 6.

Referring to FIGS. 4 to 6 and 9 to 10, the sealer 7 seals a rear end of the electrical connector 100. The sealer 7 is glue-filled through the opening 450 of the shielding shell 4 so as to fill the space between the base 11 and the rear end portion 13 of the insulative housing 1 and the outer shell 6 to fully achieve the waterproof effect. When gluing, the vent 51 in the metal shell 5 can be used to eliminate the air in the glue flow passage.

Referring to FIGS. 1 to 2 and 9 to 10, the corresponding electrical connector 200 includes an outer shielding shell 9. The corresponding electrical connector 200 inserts into the receiving room 60 and the outer shielding shell 9 resists against the o-ring 8 when the corresponding electrical connector 200 is mated with the electrical connector 100. The electrical connector 100 is provided with the o-ring 8 covering the front end of the outer shell 6 inwardly and outwardly, which not only ensures the waterproof effect between the electrical connector 100 and the electrical device, but also ensures the waterproof effect between the corresponding electrical connector 200 and the electrical connector 100 when the electrical connector 100 is inserted. Further referring to FIGS. 5 and 7 additionally, the shielding shell 4 further includes opposite upper and lower bulged regions 45 protruding into the mating room 40 for abutment against the plug connector 200 in the vertical direction perpendicular to the front-to-back direction. Notably, during mating the plug connector 200 and the receptacle connector 100 forms abutments with regard to the plug connector 200 at two spaced positions in the front-to-back direction, i.e., the internal attached surface 83 of the O-ring 8 at the front position and the bulged regions 45 at the rear position wherein the internal attached surface 83 is essentially fully circumferential in a compressed manner while the bulged regions 45 are spaced from one another in a transverse direction perpendicular to both the front-to-back direction and the vertical direction. Because of the dual-point retention between the outer shell 9 of the plug connector 200 and the continuous depressed internal attached surface 83 of the compressed O-ring 8 which is attached to the front end of the outer insulative shell 6 as the front retention, and between the outer shell 9 of the plug connector 200 and the spaced bulged regions 45 of the metallic shielding shell 4, the mating between the plug connector 200 and the receptacle connector 100 is essentially in a reliable and stable sealing manner. As shown in FIG. 9, a circumferential gap S is formed between the plug connector 200 and the receptacle connector 100 and between the internal attached surface 83 of the O-ring 8 and the bulged regions 45 of the shielding shell 4 in the front-to-back direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion;

a plurality of conductive contacts affixed to the insulative housing;

a shell enclosing the insulative housing for forming a receiving room, the shell having a front surface, an outer surface and an inner surface, a mating room being defined between the inner surface of the shell and the tongue portion; and an o-ring attached to a front end of the shell; wherein the o-ring comprises an internal attached surface attached to the inner surface of the shell, wherein the o-ring is formed of liquid silicone at the front end of the shell, and the o-ring is attached to the front surface, the outer surface and the inner surface at the front end of the shell, wherein the shell comprises a cylindrical shielding shell and an outer shell, and the o-ring is disposed at a front end of the outer shell, wherein the outer shell is integrally formed with a metal shell in a plate shape, and the metal shell comprises a plurality of overfill holes filled by the outer shell, wherein the outer shell comprises the receiving room receiving the shielding shell, and the tongue portion extends forwardly and outwardly from the shielding shell and is received in the receiving room, wherein the inner surface of the outer shell comprises a front inner wall and a rear inner wall recessed in the front inner wall and having a stepped portion, and the cylindrical shielding shell is attached to the rear inner wall so that a front opening of the shielding shell resists against the stepped portion and an upper edge and a lower inner edge of the cylindrical shielding shell are flush with the front inner wall, wherein the outer shell comprises an inner attached surface located at a front end thereof, an outer attached surface opposite to the inner attached surface, and a front surface connecting the inner attached surface and the outer attached surface, the o-ring comprises an external attached surface attached to the outer attached surface, the internal attached surface, and a front attached surface attached to the front surface.

2. The electrical connector as claimed in claim 1, wherein the shielding shell is fixed to the metal shell by welding.

3. The electrical connector as claimed in claim 1, wherein the base portion comprises a pair of grooves located at a rear end thereof, and the shielding shell comprises a pair of first tubers bent upwardly and received in the grooves.

4. The electrical connector as claimed in claim 1, wherein the metal shell comprises a plurality of first affixed portions and second affixed portions bending and hanging downwardly laterally, the first affixed portions are located at a level lower than the second affixed portions, and the first affixed portions are partially covered by the outer shell.

5. An electrical receptacle connector for mating with a plug connector having a metallic outer shielding shell, comprising:

an insulative housing including a base portion and a tongue portion extending forwardly from the base portion in a front-to-back direction;

a plurality of conductive contacts affixed to the housing;

a shell subassembly enclosing the housing and defining a receiving room in which the tongue portion extends and said metallic outer shielding shell of the plug connector is received;

a compressible extension attached upon a front end region of the shell subassembly and defining an internal attached surface covering an inner attached surface of the shell subassembly and exposed toward the receiving room; and a plurality of bulged regions formed on the shell subassembly and inwardly protruding into the receiving room in a vertical direction perpendicular to said front-to-back direction; wherein during mating, said internal attached surface and said bulged regions commonly form a dual-point retention with the plug connector in the front-to-back direction, wherein said compressible extension further includes an external attached surface to cover an outer attached surface of the shell subassembly which is opposite to the inner attached surface of the shell subassembly, wherein said compressible extension is an O-ring defining a continuously circumferential slot to receive the front end region of the shell subassembly, wherein said shell subassembly includes an inner metallic shielding shell and an outer insulative shell having a stepped portion behind which said inner metallic shielding shell is located, and wherein the compressible extension is attached upon the outer insulative shell and the bulged regions are formed on the inner metallic shielding shell.

6. The electrical receptacle connector as claimed in claim 5, wherein said compressible extension continuously extends in a circumferential manner while said bulged regions are spaced from one another in a transverse direction perpendicular to said front-to-back direction.

7. An electrical receptacle connector for mating with a plug connector having a metallic outer shielding shell, comprising:

an insulative housing including a base portion and a tongue portion extending forwardly from the base portion in a front-to-back direction;

a plurality of conductive contacts affixed to the housing;

a shell subassembly enclosing the housing and defining a receiving room in which the tongue portion extends and said metallic outer shielding shell of the plug connector is received;

a compressible extension attached upon a front end region of the shell subassembly and defining an external attached surface to cover an outer attached surface of the shell subassembly and an internal attached surface opposite to said external attached surface to cover an inner attached surface of the shell subassembly and exposed toward the receiving room, wherein said shell subassembly includes an outer insulative shell and an inner metallic shielding shell which is located behind a stepped portion of said outer insulative shell in the front-to-back direction and forms a plurality of bulged regions extending into the receiving room in a vertical direction perpendicular to said front-to-back direction, and spaced from one another in a transverse direction perpendicular to both said front-to-back direction and said vertical direction, wherein said compressible extension is attached upon the outer insulative shell, and is spaced from the plurality of bulged regions in the front-to-back direction.

8. The electrical receptacle connector as claimed in claim 7, wherein said compressible extension is an O-ring and defines a continuous circumferential slot to receive the front end region of the shell subassembly.

9. The electrical receptacle connector as claimed in claim 7, wherein said external attached surface extends rearwardly beyond the internal attached surface in the front-to-back direction.

* * * * *